US010982641B2

(12) United States Patent
Armbrecht et al.

(10) Patent No.: US 10,982,641 B2
(45) Date of Patent: Apr. 20, 2021

(54) IGNITION DEVICE FOR IGNITING AN AIR/FUEL MIXTURE IN A COMBUSTION CHAMBER

(71) Applicant: Rosenberger Hochfrequenztechnik GmbH & Co. KG, Fridolfing (DE)

(72) Inventors: Gunnar Armbrecht, Mühldorf (DE); Martin Fuchs, Freilassing (DE); Michael Wollitzer, Fridolfing (DE); Marcel Van Delden, Bochum (DE); Thomas Musch, Bochum (DE); Sven Groger, Bochum (DE); Andre Bergner, Bottrop (DE); Gordon Notzon, Bochum (DE); Peter Awakowicz, Bochum (DE)

(73) Assignee: Rosenberger Hochfrequenztechnik GMBH & CO. KG, Fridolfing (DE)

( * ) Notice: Subject to any disclaimer, the term of this patent is extended or adjusted under 35 U.S.C. 154(b) by 0 days.

(21) Appl. No.: 16/087,738

(22) PCT Filed: Mar. 23, 2017

(86) PCT No.: PCT/EP2017/000363
§ 371 (c)(1),
(2) Date: Sep. 24, 2018

(87) PCT Pub. No.: WO2017/167438
PCT Pub. Date: Oct. 5, 2017

(65) Prior Publication Data

US 2020/0011283 A1 Jan. 9, 2020

(30) Foreign Application Priority Data

Mar. 29, 2016 (DE) ..... 102016003793.8

(51) Int. Cl.
*F02P 3/01* (2006.01)
*F02P 3/055* (2006.01)
*F02P 9/00* (2006.01)
*F02P 11/00* (2006.01)
(Continued)

(52) U.S. Cl.
CPC ..... *F02P 3/01* (2013.01); *F02P 3/055* (2013.01); *F02P 9/00* (2013.01); *F02P 11/00* (2013.01); *F02P 7/10* (2013.01); *H05H 1/46* (2013.01)

(58) Field of Classification Search
CPC ..... F02P 3/01; F02P 3/055; F02P 9/00; F02P 11/00; F02P 7/10
See application file for complete search history.

(56) References Cited

U.S. PATENT DOCUMENTS 1,335,797 A * 4/1920 Rohde ..... H01T 13/22 439/709
3,747,582 A * 7/1973 Kato ..... F02P 3/0884 123/599
(Continued)

FOREIGN PATENT DOCUMENTS

CN 105264218 1/2016
DE 112014002666 T5 3/2017
(Continued)

*Primary Examiner* — Mahmoud Gimie
*Assistant Examiner* — Joshua Campbell
(74) *Attorney, Agent, or Firm* — DeLio Peterson & Curcio LLC; Robert Curcio

(57) ABSTRACT

An ignition device for igniting an air/fuel mixture in a combustion chamber, in particular of an internal combustion engine, having a spark plug which has a first electrode and a second electrode, having a high voltage source for generating an electrical high voltage pulse at an output of the high voltage source, and having a high frequency voltage source for generating an electrical high frequency alternating voltage at an output of the high frequency voltage source, wherein the output of the high voltage source is connected
(Continued)

electrically to the first electrode of the spark plug via a first electrical conduction path in such a way that the high voltage pulse is present at the first electrode, wherein the output of the high frequency voltage source is connected electrically to the second electrode via a second electrical conduction path in such a way that the high frequency alternating voltage is present at the second electrode.

13 Claims, 2 Drawing Sheets

(51) Int. Cl.
*H05H 1/46* (2006.01)
*F02P 7/10* (2006.01)

(56) References Cited

U.S. PATENT DOCUMENTS 3,934,566 A * 1/1976 Ward ..... F02P 9/007 123/275
4,297,983 A * 11/1981 Ward ..... F02P 23/04 123/536
4,369,756 A * 1/1983 Ezoe ..... F02P 15/12 123/179.5
2013/0148254 A1* 6/2013 Katsuraya ..... F02P 3/01 361/253
2014/0116405 A1* 5/2014 Tanaya ..... F02P 3/02 123/634

FOREIGN PATENT DOCUMENTS

EP 2615704 A1 7/2013
EP 2667013 A1 11/2013
EP 2687714 A2 1/2014
EP 2775136 A1 9/2014
JP 2008082286 A 4/2008
JP 2011134636 A * 7/2011 ..... F02P 9/007
JP 2011134636 A 7/2011
JP 5152653 B2 * 2/2013 ..... F02P 3/01

* cited by examiner

IGNITION DEVICE FOR IGNITING AN AIR/FUEL MIXTURE IN A COMBUSTION CHAMBER

BACKGROUND OF THE INVENTION

1. Field of the Invention

The invention relates to an ignition device for igniting an air/fuel mixture in a combustion chamber, in particular of an internal combustion engine, having a spark plug which has a first electrode and a second electrode, having a high voltage source for generating an electrical high voltage pulse or high DC voltage pulse at an output of the high voltage source and having a high frequency voltage source or high frequency alternating voltage source for generating an electrical high frequency alternating voltage at an output of the high frequency voltage source, wherein the output of the high voltage source is connected electrically to the first electrode of the spark plug via a first electrical conduction path in such a way that the high voltage pulse is present at the first electrode.

2. Description of Related Art

So-called Otto combustion processes with direct fuel injection offer considerable potential for reducing consumption due to the possibility of implementing a stratified charging in the combustion chamber. However, the inhomogeneous mixture in the combustion chamber places increased requirements on the ignition method used in terms of achieving a reliable ignition at the appropriate time. For example, fluctuations of any kind reduce the quality of the ignition and thus the overall efficiency of the engine. On the one hand, the position of the ignitable mixture can vary slightly, and on the other hand the hook of the ground electrode of the spark plug can interfere with the formation of the mixture. Helpful for a direct injection combustion process is an ignition system with a greater spatial extension into the combustion chamber. To this end, DE 10 2004 058 925 A1 suggests igniting a fuel-air-mixture in a combustion chamber of an internal combustion engine by means of a plasma. A corresponding high-frequency plasma ignition device comprises a series resonant circuit with an inductance and a capacitance and a high-frequency source for resonant excitation of this series resonant circuit. The capacitance is represented by inner and outer conductor electrodes with an interposed dielectric. The outermost ends of these electrodes extend into the combustion chamber spaced apart at a specified distance.

A method for ignition is known from DE 10 2008 051 185 A1 in which a spark plasma is generated by means of a high voltage pulse which is then further heated by means of a HF field and thereby changes into a glow discharge. The high voltage pulse and an output signal of a HF generator are thereby fed jointly to a spark electrode of a spark plug. A return electrode of the spark plug is earthed.

Nowadays, modern ignition systems for petrol engines comprise a spark plug and a single ignition coil with electronic control unit. The spark plug has a coaxial structure and consists substantially of a central electrode surrounded by an insulator and an outer electrode which is connected to the spark plug housing. The ignition coil supplies the spark plug with a high voltage pulse or high DC voltage pulse. A spark is generated between the electrodes which initiates the combustion. An alternative method in which, in addition to the applied high voltage from the ignition coil, a high frequency voltage is applied to the spark plug is described in DE 10 2013 215 663 A1. The spark plasma hereby changes into a HF plasma.

In the classic ignition concepts described above, the spark plasma burns between two electrodes, an active "driven" electrode (also referred to as the high voltage electrode) and a passive electrode (also referred to as the ground electrode), the potential of which is connected to the ground (0V) of the engine block as well as the whole bodywork of a car. The ground electrode can also be designed in the form of a multiple electrode. These ignition systems have the disadvantage, arising from the underlying principle, of poor controllability, since after ignition of the plasma the energy stored in the ignition coil is only coupled into the plasma for a time scale of a few tens of nanoseconds. The steeply increasing current is a consequence of the swiftly increasing electron density and the associated increase in the conductivity of the plasma. All subsequent processes in the plasma are simply a consequence of this input of energy and can no longer be externally influenced. In particular, no further heating of the plasma takes place. The consequence of this is that no significant generation of free electrones and thus of reactive species, for example atomic oxygen, which promote combustion, takes place. The combustion, on the other hand, takes place over significantly longer time scales, but depends on the previously generated density of atomic oxygen.

SUMMARY OF THE INVENTION

The invention is based on the problem of improving an ignition device of the aforementioned type in terms of the possibilities of influencing the parameters of the plasma between the electrodes of the spark plug.

According to the invention this problem is solved through an ignition device of the aforementioned type with the characterizing features of the independent claims. Advantageous variants of the invention are described in the further dependent claims.

The above and other objects, which will be apparent to those skilled in the art, are achieved in the present invention which is directed to an ignition device for igniting an air/fuel mixture in a combustion chamber, with a spark plug having exactly two electrodes namely a first electrode and a second electrode, having a high voltage source for generating an electrical high voltage pulse at an output of the high voltage source and having a high frequency voltage source for generating an electrical high frequency alternating voltage at an output of the high frequency voltage source, wherein the output of the high voltage source is connected electrically to the first electrode of the spark plug via a first electrical conduction path in such a way that the high voltage pulse is present at the first electrode, and wherein the output of the high frequency voltage source is connected electrically to the second electrode via a second electrical conduction path in such a way that the high frequency alternating voltage is present at the second electrode.

The high voltage source is preferably designed in the form of an ignition coil.

A protective circuit is looped electrically into the second electrical conduction path between the second electrode of the spark plug and the output of the high frequency voltage source which blocks a breakdown of the high voltage pulse from the high voltage source to the output of the high frequency voltage source.

An isolating element in the form of a frequency-selective filter may be looped electrically into the second electrical conduction path between the second electrode of the spark plug and the output of the high frequency voltage source.

The isolating element may be looped into the second electrical conduction path between the protective circuit and the output of the high frequency voltage source.

The isolating element may be looped into the second electrical conduction path between the protective circuit and the second electrode.

A protective circuit is looped electrically into the first electrical conduction path between the output of the high voltage source and the first electrode of the spark plug, which represents a ground reference for the HF.

In at least one embodiment, only the high voltage pulse is present at the first electrode and that only the high frequency alternating voltage is present at the second electrode.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
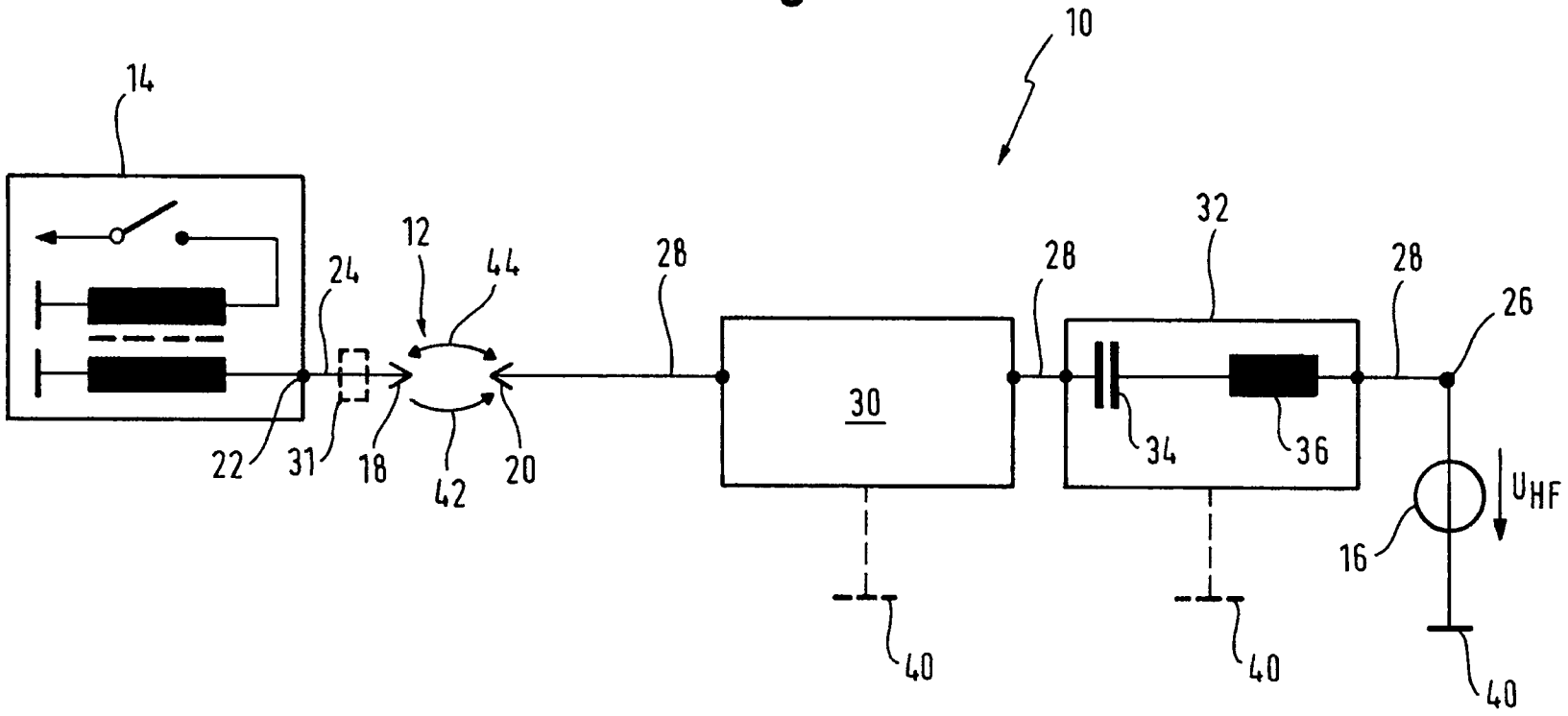
FIG. 1 shows a schematic representation of a preferred embodiment of an ignition device according to the invention.

In describing the embodiment of the present invention, reference will be made herein to FIGS. 1-2 of the drawings in which like numerals refer to like features of the invention.

In an ignition device of the aforementioned type, according to the invention the output of the high frequency voltage source is connected electrically to the second electrode via a second electrical conduction path in such a way that the high frequency alternating voltage is present at the second electrode.

This has the advantage that two active electrodes are provided, so that, following the ignition of a plasma between the two electrodes of the spark plug by the high voltage pulse, the high frequency alternating voltage can immediately couple further energy into the plasma at a significantly lower level of the electrical voltage.

A particularly simple and functionally reliable ignition device is achieved in that the high voltage source is designed in the form of an ignition coil.

A protection of the high frequency voltage source against overvoltage is achieved in that a protective circuit is looped electrically into the second conduction path between the second electrode of the spark plug and the output of the high frequency voltage source which blocks a breakdown of the high voltage pulse from the high voltage source to the output of the high frequency voltage source.

A frequency-selective transmission, for example of only one desired frequency band, from the high frequency voltage source to the second electrode of the spark plug is achieved in that an isolating element in the form of a frequency-selective filter, in particular in the form of a band pass filter, is looped electrically into the second electrical conduction path between the second electrode of the spark plug and the output of the high frequency voltage source.

A protection also of the isolating element against overvoltage is achieved in that the isolating element is looped into the second electrical conduction path between the protective circuit and the output of the high frequency voltage source.

In a preferred further development of the invention, the isolating element is looped into the second electrical conduction path between the protective circuit and the second electrode. This has the advantage that the band pass of the isolating element attenuates the energy outside of the band pass range, which simplifies realization of the protective circuit.

An improved transmission of the high voltage from the high voltage source to the spark plug is achieved in that a protective circuit is looped electrically into the first electrical conduction path between the output of the high voltage source and the first electrode of the spark plug which represents a ground reference for the HF.

A clear separation between the two active electrodes is achieved in that only the high voltage pulse is present at the first electrode and that only the high frequency alternating voltage is present at the second electrode.

The invention is explained in more detail in the following with reference to the drawings.

The preferred embodiment of an ignition device 10 according to the invention represented in FIG. 1 has a spark plug 12, a high voltage source or high DC voltage source 14 and a high frequency voltage source 16. The spark plug 12 has a first electrode 18 (high voltage electrode) and a second electrode 20 (high frequency electrode). The electrodes 18, 20 project into a combustion chamber (not shown), for example into a working cylinder of an internal combustion engine, in which a fuel-air mixture is to be ignited. The high voltage source 14 is designed in the form of an ignition coil and generates a high voltage pulse or high DC voltage pulse (DC), which is present at an output 22 of the high voltage source 14. In this case the expression "electrical high DC voltage pulse" refers to an electrical DC voltage pulse with high electrical voltage of a few kV, for example 3 kV to 30 kV or 8 kV to 12 kV. The output 22 of the high voltage source 14 is connected electrically to the first electrode 18 via a first electrical conduction path 24 in such a way that the high voltage pulse from the high voltage source 14 is fed to the first electrode 18 of the spark plug 12. The electrical high voltage pulse is hereby only present at the first electrode (18).

The high frequency voltage source 16 generates a high frequency alternating voltage, which is present at an output 26 of the high frequency voltage source 16. The output 26 of the high frequency voltage source 16 is connected electrically to the second electrode 20 of the spark plug 12 via a second electrical conduction path 28 in such a way that the high frequency alternating voltage from the high frequency voltage source 16 is fed to the second electrode 20 of the spark plug 12. The high frequency voltage source 16 is also connected electrically to an electrical ground potential 40. The high frequency alternating voltage is hereby only present at the second electrode (20).

A protective circuit 30 is looped electrically into the second electrical conduction path 28. This protective circuit 30 is configured in such a way that on the one hand it prevents the high voltage pulse from the high voltage source 14 from breaking through via the second electrical conduction path 28 to the output 26 of the high frequency voltage source 16 and on the other hand it passes on the high frequency alternating voltage from the high frequency voltage source 16 in the direction of the second electrode 20 of the spark plug 12. In this way, the high frequency voltage source 16 is protected against overvoltage.

An isolating element 32 is also looped electrically into the second electrical conduction path 28 between the protective circuit 30 and the output 26 of the high frequency voltage source 16. This isolating element 32 is designed in the form of a frequency-selective filter, for example as a band pass filter with a constant or variable capacitance 34 and a constant or variable inductance 36. This band pass filter only allows a predetermined frequency band to pass from the high frequency voltage source 16 via the second electrical conduction path 28 in the direction of the second electrode 20. With the isolating element 32, the coupled-in frequency of the high frequency alternating voltage can be continually adjusted, so that an optimal input of energy into the ignited plasma is achieved.

The ignition device according to the invention is designed in the form of a high frequency plasma ignition system and contains in the spark plug 12 two active electrodes, the high voltage electrode as first electrode 18 and the high frequency electrode as second electrode 20. A ground electrode, as used in conventional ignition systems, is not present. The ignition coil 14 generates a high voltage pulse or high DC voltage pulse (DC) which, on reaching a breakdown voltage between the high voltage electrode 18 and the high frequency electrode 20 of the spark plug 12, generates an initial plasma in the space around the two electrodes 18, 20 (arrow 42). This plasma is supplied with further energy through subsequent feed of the high frequency alternating voltage from the high frequency voltage source 16 (arrow 44) and is as a result maintained for a certain time, so that the plasma is present for longer than would be the case simply as a result of the high voltage pulse from the high voltage source 14.

A plasma contains, inter alia, electrons, ions, excited particles and neutral particles. The free charge carriers (electrons and ions) form a conductive plasma channel between the high voltage electrode 18 and the high frequency electrode 20 of the spark plug 12. The free charge carriers created by the plasma are used to transport current in the high frequency plasma between the high frequency electrode 20 and the high voltage electrode 18. In this way, more power can be input into the plasma over a longer period of time through the additional application of a high frequency voltage from the high frequency voltage source 16 to the high frequency electrode 20. As a result, electrons are continually generated and the density of free electrons in the plasma is maintained for longer, which is associated with a permanent generation of reactive species (above all of atomic oxygen). The significantly increased quantity of atomic oxygen ensures a more effective combustion and among other things permits the reliable ignition of lean fuel-air mixtures in the combustion chamber or an increased engine performance with constant fuel consumption. In order to protect the high frequency voltage source 16 against the high voltage pulse from the high voltage source 14, the protective circuit 30 is provided between the high frequency electrode 20 and high frequency voltage source 16. A major advantage of this ignition system is that the plasma burns directly between the two active electrodes 18, 20. A reliable takeover of the high frequency voltage source in order to continue actively coupling energy into the plasma following the initial firing through the high voltage pulse from the high voltage source 14 is ensured since the initial spark in any case generates free charge carriers between the electrodes.

The protective circuit 30 includes for example a gas-filled surge arrester, which has an insulating effect as long as the voltage remains below a predetermined value of for example around 450 V. Due to its low capacitance of only around 2 pF, the gas-filled surge arrester does not interfere. If the ignition voltage of the gas-filled surge arrester is exceeded, the resistance falls within microseconds to very low values, allowing current peaks of for example up to 100 kA to be dissipated.

The separation of high voltage and high frequency potential drastically reduces the requirements in terms of the dielectric strength of the isolating element 32. At the same time, as a result of this step the load on the high voltage source 14 in the form of the ignition coil is reduced significantly and the generation of the high voltage greatly simplified. Against the background of increasingly highly charged petrol engines, the generation of sufficiently high voltage pulses to ensure reliable ignition represents an increasingly growing challenge. Moreover, more degrees of freedom in the choice of the reactive construction elements of the isolating element are achieved, since it is no longer necessary to ensure the lowest possible capacitive load on the ignition coil. In comparison with previous switching concepts, the capacitances of the isolating element can be increased and the inductances lowered, which simplifies the realization of the isolating element.

Figure 2:
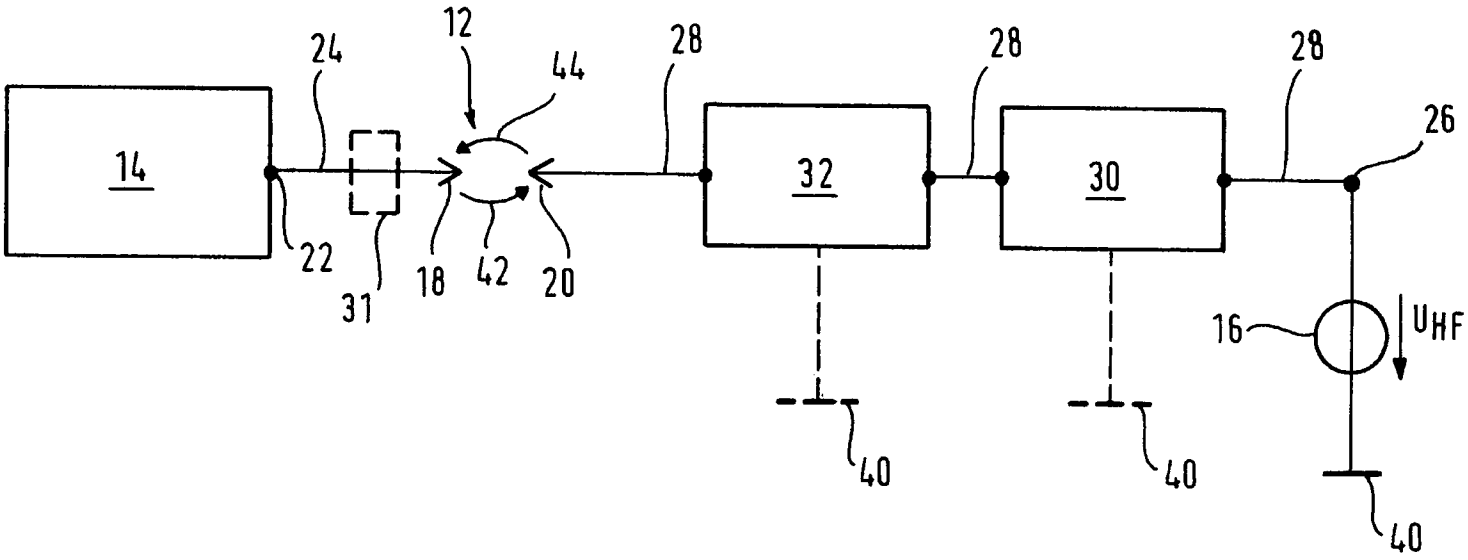
FIG. 2 shows a schematic representation of an alternative preferred embodiment of an ignition device according to the invention.

In FIG. 2, parts with the same function are identified with the same reference symbols as in FIG. 1, so that reference is made to the above description of FIG. 1 with regard to their explanation. In the second embodiment according to FIG. 2, in contrast to the first embodiment according to FIG. 1, the protective circuit 30 is looped into the second electrical conduction path 28 between the isolating element 32 and the output 26 of the high frequency voltage source 16.

Optionally, the protective circuit 30 and/or the isolating element 32 have in addition an electrical connection with the ground potential 40, as represented with broken lines in FIGS. 1 and 2.

Optionally, a protective circuit 31 with electrical connection to the ground potential 40 is looped electrically into the first electrical conduction path 24 between the output 22 of the high voltage source 14 and the first electrode 18. This protective circuit 31 is indicated accordingly in FIGS. 1 and 2 with broken lines. The protective circuit should represent a ground reference for the HF and should not block the high voltage.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An ignition device for igniting an air/fuel mixture in a combustion chamber, with a spark plug having exactly two electrodes namely a first electrode and a second electrode, having a high voltage source for generating an electrical high voltage pulse at an output of the high voltage source and having a high frequency voltage source for generating an electrical high frequency alternating voltage at an output of the high frequency voltage source, wherein the output of the high voltage source is connected electrically to the first electrode of the spark plug via a first electrical conduction path in such a way that the high voltage pulse is present at the first electrode, and wherein the output of the high frequency voltage source is connected electrically to the second electrode via a second electrical conduction path in such a way that the high frequency alternating voltage is present at the second electrode, wherein a protective circuit is looped electrically into the second electrical conduction path between the second electrode of the spark plug and the output of the high frequency voltage source which blocks a breakdown of the high voltage pulse from the high voltage source to the output of the high frequency voltage source; and wherein only the high voltage pulse is present at the first electrode and that only the high frequency alternating voltage is present at the second electrode.

2. The ignition device of claim 1, wherein the high voltage source is designed in the form of an ignition coil.

3. The ignition device of claim 1, wherein an isolating element in the form of a frequency-selective filter is looped electrically into the second electrical conduction path between the second electrode of the spark plug and the output of the high frequency voltage source.

4. The ignition device of claim 1, wherein an isolating element is looped into the second electrical conduction path between the protective circuit and the output of the high frequency voltage source.

5. The ignition device of claim 1, wherein an isolating element is looped into the second electrical conduction path between the protective circuit and the second electrode.

6. The ignition device of claim 1, wherein a protective circuit is looped electrically into the first electrical conduction path between the output of the high voltage source and the first electrode of the spark plug, and wherein the protective circuit is connected to ground.

7. The ignition device of claim 1, wherein only the high voltage pulse is present at the first electrode and that only the high frequency alternating voltage is present at the second electrode.

8. The ignition device of claim 1, wherein the combustion chamber is within an internal combustion engine.

9. The ignition device of claim 3, wherein the frequency-selective filter is in the form of a band pass filter.

10. The ignition device of claim 2, wherein an isolating element in the form of a frequency-selective filter is looped electrically into the second electrical conduction path between the second electrode of the spark plug and the output of the high frequency voltage source.

11. The ignition device of claim 3, wherein the isolating element is looped into the second electrical conduction path between the protective circuit and the output of the high frequency voltage source.

12. The ignition device of claim 3, wherein the isolating element is looped into the second electrical conduction path between the protective circuit and the second electrode.

13. The ignition device of claim 10, wherein a protective circuit is looped electrically into the first electrical conduction path between the output of the high voltage source and the first electrode of the spark plug, and wherein the protective circuit is connected to ground.

* * * * *